US010098466B2

(12) United States Patent
Donati

(10) Patent No.: US 10,098,466 B2
(45) Date of Patent: Oct. 16, 2018

(54) CHAIR WITH ADJUSTABLE BACKREST

(71) Applicant: Donati S. P.A., Rodengo Saiano (IT)

(72) Inventor: Armando Donati, Rodengo Saiano (IT)

(73) Assignee: Donati S.p.A., Rodengo Saiano (BS) (IT)

( * ) Notice: Subject to any disclaimer, the term of this patent is extended or adjusted under 35 U.S.C. 154(b) by 53 days.

(21) Appl. No.: 15/104,398

(22) PCT Filed: Dec. 11, 2014

(86) PCT No.: PCT/EP2014/077362
§ 371 (c)(1),
(2) Date: Jun. 14, 2016

(87) PCT Pub. No.: WO2015/091199
PCT Pub. Date: Jun. 25, 2015

(65) Prior Publication Data

US 2016/0309902 A1 Oct. 27, 2016

(30) Foreign Application Priority Data

Dec. 17, 2013 (EP) ..... 13197786

(51) Int. Cl.
*A47C 7/44* (2006.01)
*A47C 1/032* (2006.01)

(52) U.S. Cl.
CPC ..... *A47C 7/441* (2013.01); *A47C 1/03255* (2013.01); *A47C 1/03266* (2013.01); *A47C 1/03272* (2013.01); *A47C 7/443* (2013.01)

(58) Field of Classification Search
CPC . A47C 1/03266; A47C 1/03272; A47C 7/441; A47C 7/443
See application file for complete search history.

(56) References Cited

U.S. PATENT DOCUMENTS 2,746,520 A 5/1956 Ducrot
3,640,566 A 2/1972 Hodge
(Continued)

FOREIGN PATENT DOCUMENTS

DE 2026929 A1 12/1970
DE 87 13 972 U1 11/1987
(Continued)

OTHER PUBLICATIONS

International Search Report and Written Opinion for International Application No. PCT/IB2014/060263 (dated Oct. 27, 2014) (8 pages).
(Continued)

*Primary Examiner* — Timothy J Brindley
(74) *Attorney, Agent, or Firm* — Lucas & Mercanti LLP

(57) ABSTRACT

A device for adjusting the tilt of a chair backrest having a backrest frame rotatable with respect to the base frame of the chair is provided. The device includes elastic means for returning the backrest and/or countering the rotation thereof, in addition to means for controlling the preload of the elastic means. The means for controlling the preload include at least one first connecting rod and at least one first crank. The first connecting rod is hinged to the first crank and constrained to the elastic means so as to move the point of application of the returning and/or countering force with respect to the backrest. Adjusting means to adjust the position of the first crank determine at least two distinct stable positions of the first crank corresponding to two distinct positions of the mentioned point of application of the returning and/or countering force with respect to the base frame.

5 Claims, 4 Drawing Sheets

(56) References Cited

U.S. PATENT DOCUMENTS

| | | | | |
|---|---|---|---|---|
| 4,695,093 | A | 9/1987 | Suhr et al. | |
| 4,765,679 | A | 8/1988 | Lanuzzi | |
| 5,026,117 | A * | 6/1991 | Faiks | A47C 3/026 267/131 |
| 5,251,958 | A | 10/1993 | Roericht et al. | |
| 5,397,165 | A | 3/1995 | Itzhak et al. | |
| 5,577,802 | A | 11/1996 | Cowan et al. | |
| 6,283,548 | B1 * | 9/2001 | Husemann | A47C 1/03255 297/300.1 |
| 6,709,057 | B2 | 3/2004 | Sander et al. | |
| 6,848,042 | B1 | 1/2005 | Cambell et al. | |
| 6,959,965 | B2 | 11/2005 | Diffrient | |
| 7,281,764 | B2 * | 10/2007 | Thole | A47C 1/03255 297/300.5 |
| 8,528,973 | B2 | 9/2013 | Sander et al. | |
| 8,615,828 | B2 | 12/2013 | Schermel | |
| 8,714,645 | B2 * | 5/2014 | Cvek | A47C 3/026 297/301.4 |
| 8,973,995 | B2 | 3/2015 | Donati | |
| 9,004,597 | B2 * | 4/2015 | Battey | A47C 1/032 297/285 |
| 9,402,478 | B2 * | 8/2016 | Hasegawa | A47C 1/023 |
| 2004/0026973 | A1 | 2/2004 | Sander et al. | |
| 2004/0140702 | A1 | 7/2004 | Daeschle et al. | |
| 2004/0227385 | A1 | 11/2004 | Piretti | |
| 2009/0195040 | A1 | 8/2009 | Birbeck | |
| 2009/0302655 | A1 * | 12/2009 | Gorgi | A47C 1/03255 297/303.1 |
| 2015/0374132 | A1 * | 12/2015 | Bock | A47C 1/03255 297/303.4 |
| 2016/0174720 | A1 * | 6/2016 | Sander | A47C 7/441 297/303.4 |

FOREIGN PATENT DOCUMENTS

| | | | |
|---|---|---|---|
| DE | 3735256 | A1 | 4/1989 |
| DE | 4118570 | A1 | 12/1992 |
| DE | 19607136 | A1 | 8/1996 |
| DE | 20 2005 011725 | U1 | 12/2006 |
| DE | 202007001395 | U1 | 6/2008 |
| EP | 0 613 642 | A1 | 9/1994 |
| EP | 0540711 | B1 | 9/1996 |
| EP | 1256294 | A2 | 11/2002 |
| EP | 1353584 | A1 | 10/2003 |
| EP | 1 396 213 | A1 | 3/2004 |
| EP | 1440632 | A1 | 7/2004 |
| EP | 1874161 | B1 | 1/2008 |
| EP | 2375938 | A1 | 10/2011 |
| WO | 9220262 | A1 | 11/1992 |
| WO | 0074531 | A2 | 12/2000 |
| WO | 2008149224 | A1 | 12/2008 |
| WO | 2010103554 | A1 | 9/2010 |
| WO | 2013017279 | A1 | 2/2013 |

OTHER PUBLICATIONS

International Search Report for International Application No. PCT/IT2009/000065 (dated Dec. 4, 2009).
Introduction to Vector Analysis, Cambridge University Press, 1970 (3 Pages).
Substantiation of Opposition Against EP2375938B1, dated Jun. 18, 2013. (29 Pages).
Communication of Notice of Opposition Application No. 09787650.2-1656 (dated Jun. 27, 2013) (7 Pages).
International Search Report and Written Opinion for International Application No. PCT/EP2014/077362 (11 pages) (dated Feb. 16, 2015).

* cited by examiner

CHAIR WITH ADJUSTABLE BACKREST

CROSS-REFERENCE TO RELATED APPLICATIONS

This application is a 371 of PCT/EP2014/077362, filed Dec. 11, 2014, which claims the benefit of European Patent Application No. 13197786.0 filed Dec. 17, 2013.

FIELD OF THE INVENTION

The present invention relates to the chair field, particularly to chairs provided with an adjustable tilt backrest, such as for example office chairs.

BACKGROUND OF THE INVENTION

In the art, various systems to adjust the backrest are known, and particularly to adjust the tilt thereof.

In some systems, it is possible to adjust the backrest in different fixed positions. In these cases, a user adjusts the backrest tilt according to its own needs, and then imposes that this position is kept whereby the backrest holds the position regardless of the force the user applies on it, and particularly the force the back of a user using the chair applies.

Systems providing greater use portability are known in the art.

For example, chairs are known provided with elastic means, typically torsion springs, to counterbalance the weight of the user against the backrest. In such systems, when the user leans against the backrest, the latter tilts so as to deform the spring from its resting condition, compressing or tensioning it. As known, the higher is the compression or tension of the spring with respect to its undeformed state, the higher is its resistant force, whereby the backrest tilts until it reaches an equilibrium position where the user weight is counterbalanced by the spring resistance. Alternatively, the use of gas springs is known, operating according to the same principle, whereby a higher compression of the gas spring involves a higher resistant force thereof.

These systems are effective only if the user weight is within a given range. Out of this range, for example if the user is very light or very heavy, the above mentioned equilibrium position is quite uncomfortable, since in this position the backrest is too much or too little tilted.

Therefore, further systems are known allowing to adjust the resistance provided by the spring.

In EP1874161, the backrest of a chair is integral to a rigid element whose rotation is countered by a spring action. A third class lever is interposed between the spring and the rigid element, whereby the lever end is hinged to a fulcrum and the other end is the point of application of the spring resistant force. The force operating on the backrest is applied in a point of application coincident with a slider which can move along the lever. Therefore, by varying the lever arm with respect to the pin, the resistance provided by the lever operated by the spring varies. Moreover, the slider can also move along a surface of the rigid element, which works in its turn as a lever, so as to vary the lever arm along the rigid element.

Such a system actually allows to adjust the resistance provided by the spring, allowing the users having a weight different from the standard to get a comfortable position on the chair. However, the construction of these systems may be quite complicated and, further, they do not allow a precise adjustment of the spring resistance. Due to construction, the mentioned lever has a limited length whereby a very little displacement of the pin causes the spring resistant force to widely vary, thereby a precise adjustment becomes difficult for the end user.

Similarly, WO 2010/103554 describes a system for varying the force that opposes the movement of a backrest by varying the working angle of a spring. Particularly, at one end the spring is pivoted on a fixed pin, and at the other end on a mobile pin slidable within a slot. By adjusting the position of the mobile pin along the slot, it is possible to vary the lever arm used by the backrest to work the spring.

Such a solution is not able to solve the problems of EP1874161.

SUMMARY OF THE INVENTION

It is an object of the present invention to solve the problems of the known art, and particularly to provide a chair having a tilting backrest, wherein the resistance provided by the backrest can be easily controlled and adjusted.

The present invention achieves these and other objects by means of a device according to claim 1. Preferred aspects are set forth in the independent claims.

According to the present invention, a device for adjusting the tilt of a chair backrest, of the type comprising a base frame of the chair, a backrest frame mounted at least rotatably with respect to the base frame of the chair, comprises elastic means for returning the backrest and/or countering the rotation thereof, in addition to means for controlling the preload of the elastic means. The backrest frame is directly or indirectly constrained to the elastic means in correspondence to at least one point of application of the returning/countering force of the backrest rotation.

The means for controlling the preload comprise at least one first connecting rod and at least one first crank. The first connecting rod is hinged to the first crank.

It should be noted that, herein and below, the words "hinged" and "hinge" means rotary constraints "substantially rotating", however it is not excluded that a certain clearance or compliance of said constraints is present and it allows a certain, even if limited, translation of the constrained elements with respect to each others.

The first connecting rod is further constrained to the elastic means, so that it can move said point of application of the returning/countering force as a function of the position adopted by the first connecting means with respect to the base frame.

On the contrary, the first crank is hinged to the base frame so that a first crank rotation causes the rotation of the hinge point between the first connecting rod and the first crank, with respect to the base frame.

According to the invention, adjusting means to adjust the first crank position are provided. The adjusting means determine at least two distinct stable positions of the first crank which, by means of the above described constraints between the first connecting rod and the first crank, and between the first connecting rod and the elastic means, correspond to two distinct positions of said point of application of the returning/countering force with respect to the base frame.

The kinematic system of the present invention allows a precise adjustment of the spring preload, by using few sturdy elements having a substantially conventionally shape, so that they are reliable and cost-effective.

Moreover, by using the double crank, the user can appropriately modulate the relationship between the operation of the adjusting means and the variation of the spring preload, and accordingly the variation of the resistance provided by a spring countering a user's weight leaning upon the backrest of the respective chair.

According to a preferred aspect, the elastic means comprise a mobile support.

Thanks to the mobile support, it is possible to direct the elastic means in such a way that the force the first connecting rod applies on the means themselves is applied along an optimal direction. For example, in case of elastic means comprising a torsion coil spring, the movement of the support of the elastic means allows to arrange them so that the force applied on the spring by the first connecting rod is substantially always directed along a direction parallel to the spring extension axis.

According to an aspect of the present invention, the support of the elastic means is at least rotationally constrained to the base frame of the chair.

According to another aspect of the present invention, a second connecting rod is hinged to the support of the elastic means and to the first connecting rod at one point and, at a second position, to the backrest frame.

According to another aspect of the present invention, the first connecting rod is hinged to the support of the elastic means in correspondence to or in proximity of the mentioned point of application of the returning/countering force.

According to another aspect of the present invention, the adjusting means comprise a cam device manually operable in engagement with the first crank.

According to a further aspect of the present invention, the cam device comprises at least two contact surfaces in contact with the first connecting rod. The contact surfaces are substantially flat and tilted one with respect to the other.

BRIEF DESCRIPTION OF THE DRAWINGS

Hereinafter, referring to the appended figures, an exemplary and non-limiting embodiment of the present invention will be described, wherein.

DETAILED DESCRIPTION OF THE INVENTION

Figure 1:
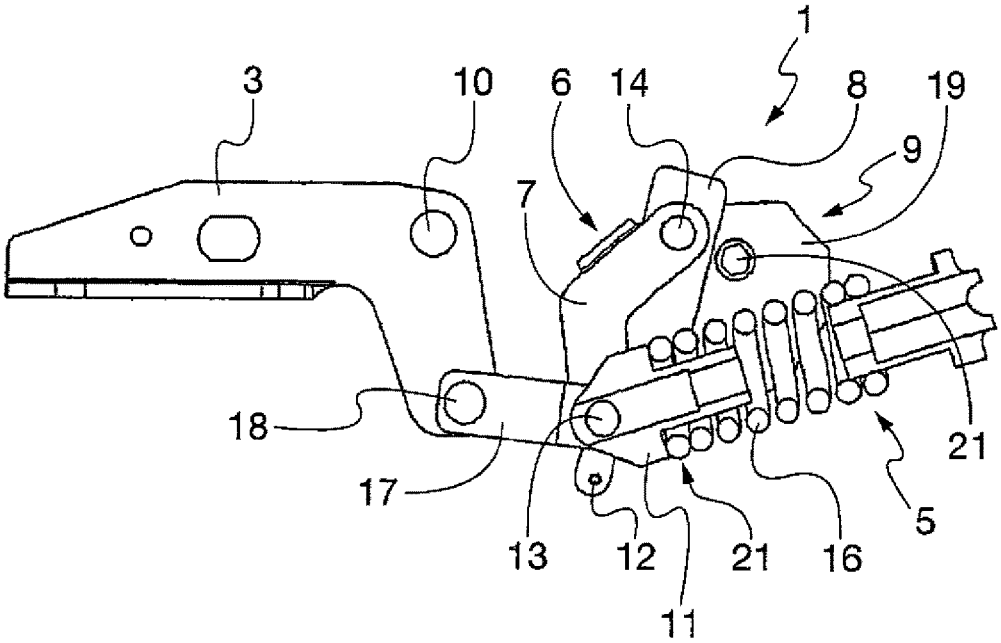
FIG. 1 is a side view of a device according to the present invention in a resting state.

Referring to the figures, a device 1 for adjusting the backrest tilt of a chair is shown. The base frame 2 of the chair (FIGS. 7 and 8), the seat frame 4 (FIGS. 6-8) and the backrest frame 3 of the chair, are shown. The backrest frame 3 is at least rotatable with respect to the base frame of the chair, and is directly or indirectly constrained to the elastic means in correspondence to at least one point 13 of application of the returning force (or anyway the force countering the rotation) applied by the elastic means 5 onto the backrest frame 3. The device 1 comprises elastic means 5 for returning the backrest, and controlling means 6 of the preload of the elastic means 5.

The controlling means 6 comprise, in turn, at least one first connecting rod 7 and a first crank 8.

The first connecting rod 7 is at least rotatable with respect to the chair frame 3 and is operatively connected to the elastic means 5 so that to apply a force on these, as better explained below.

Particularly, the first connecting rod 7 is constrained to the elastic means 5 so that to be able to move the point of application 13 of the returning force with respect to the base frame 2 of the chair.

The first crank 8 is hinged, or otherwise at least rotationally constrained, to the first connecting rod 7. The controlling means 6 further comprise adjusting means 9 to adjust the position of the first crank 8 able to determine at least two distinct stable positions thereof. The first crank 8 is at least rotationally constrained to the base frame 2 of the chair, so that the displacement of the first crank 8 between the first position and the second position causes the first connecting rod 7 to rotationally move.

The base frame 2 of the chair and the backrest frame 3 are known in the art.

Typically, the base frame 2 is integral to elements adapted to allow the chair to be supported, for example a rod provided with casters at its base, not shown in figures.

The backrest frame 3 can be moved with respect to the base frame 2 of the chair. In the shown embodiment, the frame 3 is hinged on the constraint 10 around the base frame 2 of the chair. The possibility that the backrest frame 3 have further degrees of freedom with respect to the base frame 2 of the chair is not ruled out, for example the constraint 10 could be formed by means of a mobile pin whose movement is limited by a slot. In this case, a backrest frame 3 able to roto-translate with respect to the base frame 2 of the chair will be provided.

In the herein shown present embodiment, the elastic means 5 comprise a torsion spring 16 loaded by compression. As mentioned above, "loaded by compression" means that a compression of the spring from its resting position results in a higher spring resistant force.

It is however possible to use a torsion spring working under tension, or gas springs, flexural springs or similar means.

The elastic means 5 act onto the backrest frame 3 so as to push the backrest in a position substantially perpendicular with respect to the seat or, more generally, the elastic means 5 counter the movement of the backrest, and thus of the backrest frame 3, caused by a user's weight on the backrest itself.

Preferably the elastic means 5 are provided with a support 21 mobile with respect to the base frame 2 of the chair. According to a preferred aspect, as for the backrest frame 3, the support 21 of the elastic means is at least rotatable with respect to the base frame 2 and, particularly in the shown embodiment, is hinged around the constraint 15. A limited translation of the support 21 of the elastic means with respect to the base frame 2 of the chair, is also possible.

Several shapes of the support 21 of the elastic means 5 are known in the art.

Figure 7:
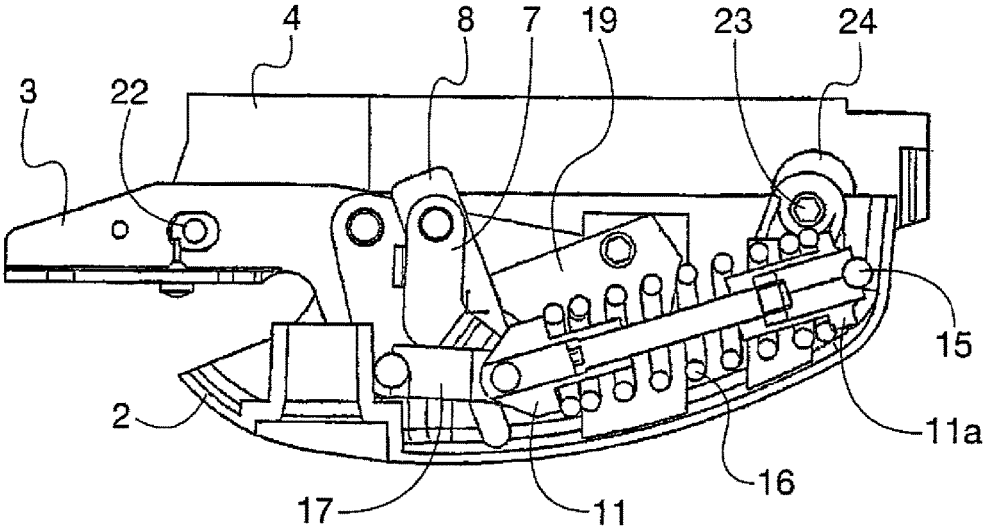
Figure 8:
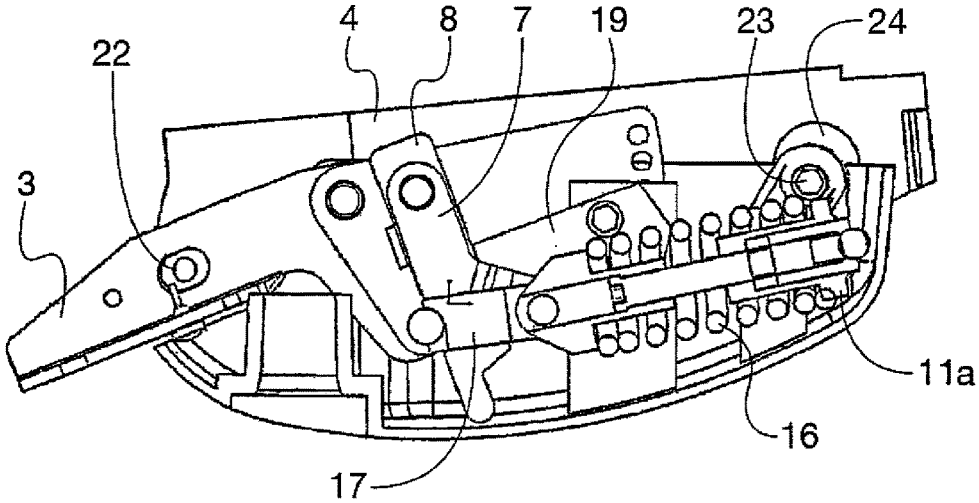

The preferred shape is shown in figures, wherein the support 21 comprises a rod 11 sliding within a portion 11*a* of the support 21, visible in FIGS. 7 and 8.

Alternatively, it is possible to provide a rod having variable length, for example a telescopic rod.

As previously disclosed, the spring preload is adjusted by means of the mechanism composed of the connecting rod 7 and the crank 8.

In the shown embodiment, the first crank 8 is rotationally constrained in the constraint 12 around the base frame 2 of the chair.

In its turn, the first connecting rod 7 is rotationally constrained to the first crank 8.

As in the above examples, it is possible to provide a roto-translation motion among the various elements, whereby the constraining points could be replaced by pins sliding within corresponding slots or slides, so that the connecting rod 7 and the crank 8 could roto-translate one with respect to the other and/or with respect to the base frame 2 of the chair.

Referring to the shown embodiment, the first connecting rod 7 is "L-shaped", and is hinged at the point of application 13 and at a hinge point provided by a constraint 14 to the rod 11 of the elastic means 5 and to the first crank 8, respectively. The "L-shape" has proved to be effective to form the embodiment shown in figures, but for the first connecting rod 7 other shapes are possible.

Further, in the embodiment shown in figures, the constraint at the point of application 13 between the backrest frame 3 and the elastic means 5 is used also to constrain the first connecting rod 7 to the elastic means 5. However, it is possible that the first connecting rod 7 and the backrest frame 3 are constrained to the elastic means 5 at positions different from one another.

The first crank 8 is preferably rod-shaped, hinged to the first connecting rod in the mentioned constraint 14 and to the base frame 2 of the chair in the mentioned constraint 12.

When the first crank 8 rotates around the constraint 12, the first connecting rod 7 is driven to move.

The movement of the first connecting rod 7 with respect to the base frame 2 of the chair is a roto-translation, and is restricted by the constraint applied by the first crank 8 in the constraint 12 and by the constraint applied by the elastic means 5 in the constraint 14.

Due to said constraint 14, the roto-translation movement of the first connecting rod 7 forced the point 13 of application to be displaced and, accordingly, force the elastic means 5 and, more particularly, the support 21 of the elastic means 5, to be at least rotated around the constraint 15.

As previously disclosed, although in the shown embodiment the constraining points 12-15 are shown as hinges, it is possible that at least one of said constraining points is actually a carriage allowing a pure translation, more or less restricted, among two or more elements of the described system.

The constraining points 12-15 (therefore including the constraint of the point of application 13) are formed for example by means of screw-bolt systems. More modifications are known in the art and are within the object of the present invention.

There can be several means to operatively connect the backrest rotation to the elastic means and multiple solutions can be used with the present invention.

The Applicant provides a solution that has proved to be particularly efficient.

In particular, the second connecting rod 17 is constrained among the elastic means 5 and the backrest frame 3.

In more detail, the second connecting rod 17 is hinged to the mentioned constraint 15 both to the elastic means 5, and particularly to the rod 11, and to the first connecting rod 7. A further constraint 18 formed in its turn as a hinge, connects the backrest frame 3 to the second connecting rod 17.

According to a modification of the present invention, the elastic means are not provided with a mobile support. In this case, the first connecting rod would not be hinged to the elastic means, but would have a pusher able to act against these elastic means. In this case, in addition to the torsion springs, it could be considered the use of flexural springs.

Hereinafter, in the explanation of the operation of a device according to the present invention, further details about the operation of these variants will be provided.

Adjusting means 9 to adjust the position of the first crank 8 are provided.

In the shown embodiment, these means comprise a cam 19 constrained to the base frame 2 of the chair in the constraint 21. Preferably, such a constraint 21 is an only-rotational constraint, although further degrees of freedom between the cam 19 and the base frame 2 are possible.

The cam 19 has several preferably flat, or substantially flat, side surfaces **20*a*-20*f*. There are at least two side surfaces 20*a*-20*f* placed at different distances from one another with respect to the constraint 21. The term "distance" means the length of the segment of a straight line perpendicular to a plane comprising the side surface 20*a*-20*f* and connecting such a plane to the constraint 21. If the side surface is not flat, such an adopted plane is the one that best fits the shape of the side surface 20*a*-20*f***.

Generally, the outer surface of the cam 19 is selected so that the rotation of the cam 19 involves a movement of the first crank 8 when the outer surface of the cam 19 is in contact with the first crank 8. Therefore also an ovoid cam 19, effectively having endless side surfaces **20*a*-20*f***, falls within the protective scope of the present invention.

Figure 6:
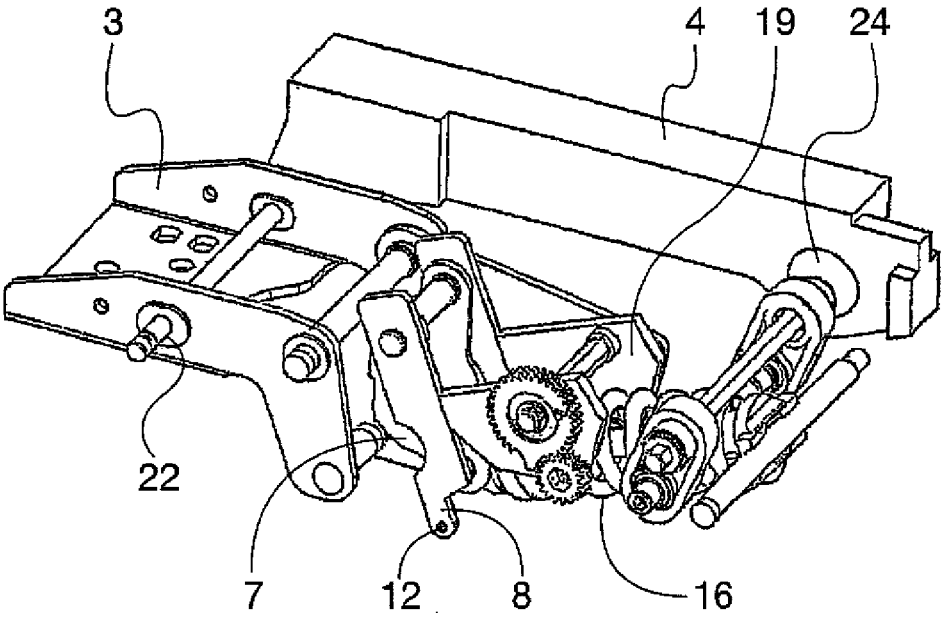
FIGS. 6-8 are views of the device of FIG. 1 inserted in a chair frame.

In FIGS. 6-8 a possible application in a chair of a device 1 according to the present invention is shown and, particularly, a possible cooperation of the device 1 according to the present invention with the seat of a chair is shown, particularly the seat frame 4 of a chair.

The seat frame 4 is hinged to the backrest frame 3. As particularly shown in FIGS. 7 and 8, a constraint 22 to constrain the seat frame 4 and the backrest frame 3 is preferably provided with a certain clearance. In particular, the constraint 22 allows a relative rotation of the two elements as well as a restricted translation of the seat frame 4 relative to the backrest frame 3, acting de facto as a carriage.

The seat frame 4 is further hinged to the seat frame 4 by means of a constraint 23. A restricted translation movement of the seat frame 4 relative to the base frame 2 of the chair can be provided, for example coupling the two elements by means of an eccentric 24 in a known way.

The operation of the device according to the present invention is disclosed hereinafter.

In the position of FIG. 1, the device is shown in a resting condition. The adjusting means 9 are designed so as to provide the minimum preload on the elastic means 6.

Figure 5:
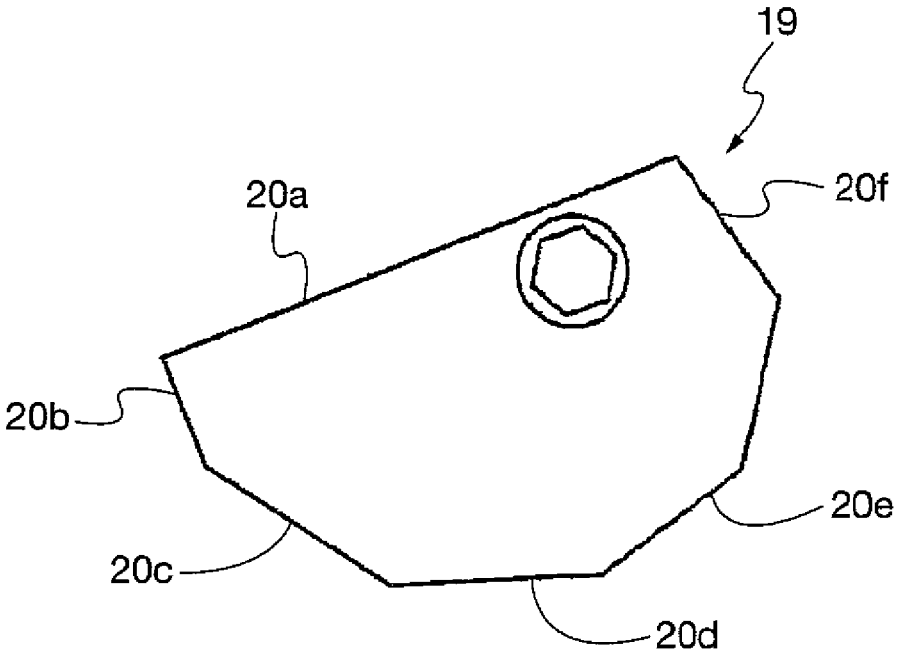
FIG. 5 is a detailed view of the adjusting means of FIG. 1.

Particularly, the cam 19 is oriented so as its surface **20*a*, that is the surface closest to the constraint 21, abuts against the first crank 4 (see FIG. 5**).

When a user back lies on the backrest, the backrest frame 3 undergoes a rotation, counterclockwise in figures, and pushes the second connecting rod 17 towards the elastic means 5, that is to the right in figures. In its turn, the first connecting rod 7 is dragged by the second connecting rod 17 by means of the constraint in the point of application 13, and rotates around the first crank 8 around the constraint 14. The first crank 8 substantially holds its position compared to the resting condition.

Figure 3:
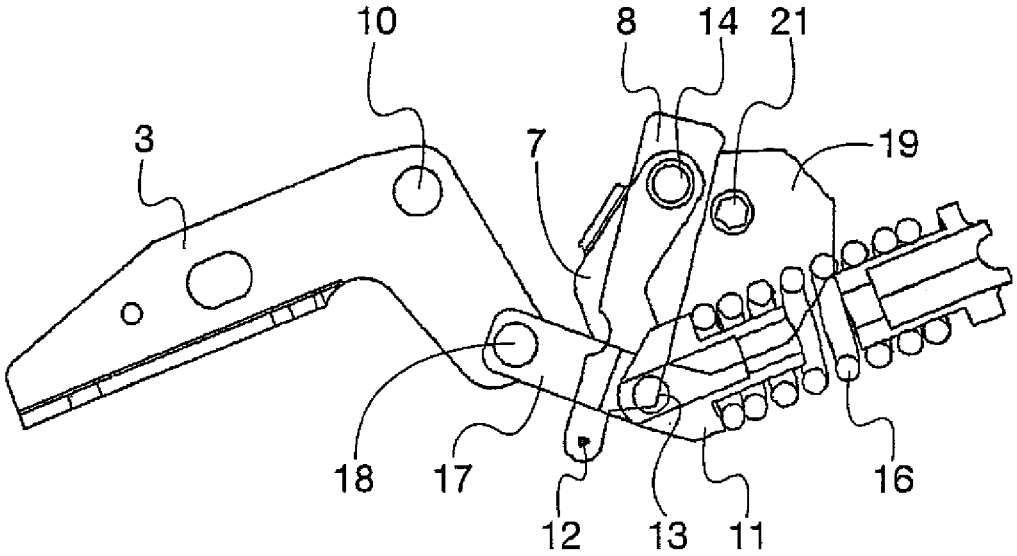
FIG. 3 is a side view of the device of FIG. 1 in an operative condition.

The elastic means are compressed by means of the constraint 15, providing a resistance against the rotation of the backrest frame 3, until an equilibrium position, shown in FIG. 3, is reached.

By operating on the adjusting means 9, generally when the device is in its resting condition, the preload of the elastic means 5 varies. Referring to the shown embodiment, the cam 19 is rotated such that the first crank 8 rests on a surface 20*b*-20*f* of the cam 19 different from the surface 20*a*.

Figure 2:
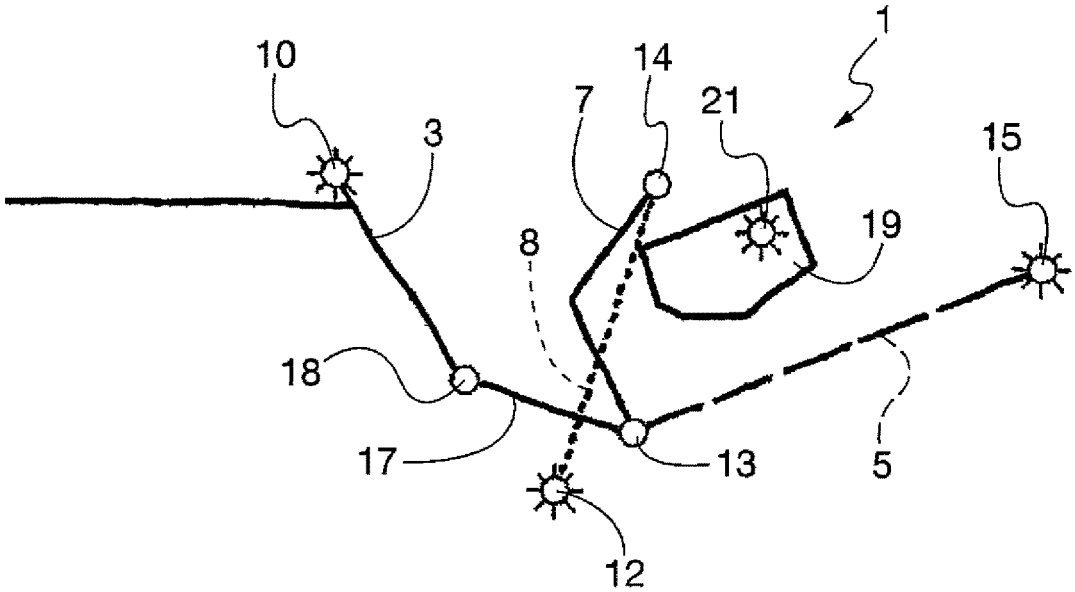
FIG. 2 is a schematic representation of the elements of a device according to the present invention.

The rotation of the cam 19 is shown in FIG. 2. Therefore the position shown in FIG. 2 is not an equilibrium position of the cam 19. The rotation of the cam 19 drags the first crank 8 and, particularly, causes a rotation of the first crank 8 around the constraint 12, for example counterclockwise in figures. Due to the constraint 14, also the first connecting rod 7 is moved. In the shown case, the first connecting rod 7 rotates clockwise and, due to the constraint 15, the elastic means 5 are slightly compressed. In more detail, it should be noted that the crank 7 is not constrained to the base frame 2 of the chair, and thus it roto-translates in the space with respect to the base frame 2 of the chair, changing moment by moment its center of rotation, performing a series of acts of rotary motion that, in the shown case, are directed clockwise.

Figure 4:
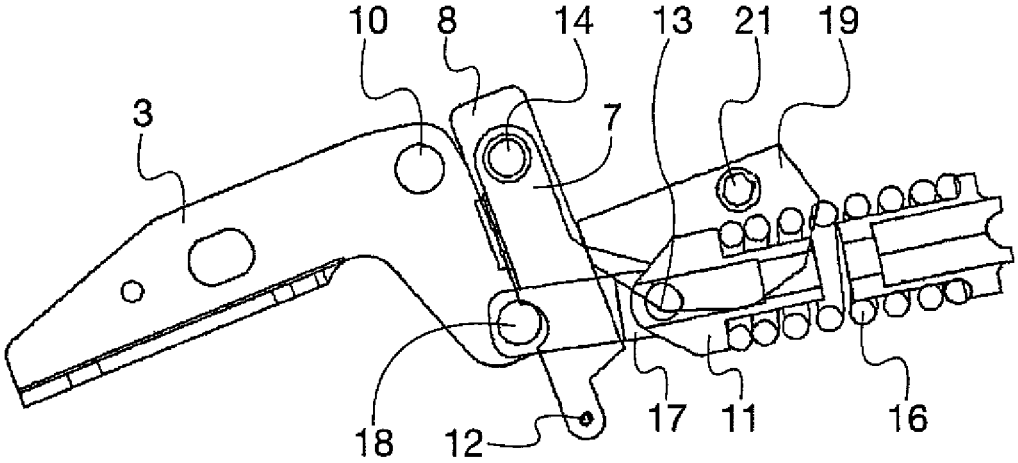
FIG. 4 is a side view of a different adjustment of the device of FIG. 1 in an operative condition similar to FIG. 3.

Compared to the situation of FIG. 1 the elastic means 5 are compressed, that is to say the preload of the elastic means 5 varies, so that a greater force is necessary to displace the backrest from the resting condition compared to the adjustment of the device 1 shown in FIGS. 1 and 3. It is therefore necessary to apply to the elastic means, and thus to the backrest, a much greater force, to be able to reach an equilibrium position with the same angle of the condition of FIG. 3. This situation is shown in FIG. 4, and it would be appreciated that the elastic means, and in this case the spring 16, are more compressed compared to the state of FIG. 3, although the backrest frame 3 is positioned at the same angle.

It is therefore apparent to a skilled person in the art that two users having different weight can reach the same angle of the backrest 3 as the equilibrium position between the force applied by their weight against the backrest of the chair and the resistance provided by the elastic means 5.

In an alternative embodiment without the elastic means, the rotation of the backrest frame causes the first crank to rotate, and the latter, for example by means of a pusher, act on the elastic means to vary their preload, for example compressing a torsion spring similar to the spring 16 or else a flexure or gas spring.

Generally, the operation of the cam 19 or of a similar adjusting means 9 can cause the crank 8 to rotate thereby driving the first connecting rod 7 to move, as in the embodiment shown. The first connecting rod 7 operates on the elastic means 5 to vary their preload by means of the mentioned pusher or the like, getting the same result as that described above with reference to the device shown in the figures.

The invention claimed is:

1. Device for adjusting the tilt of a chair backrest, said device comprising:

a base frame of the chair, a backrest frame at least rotatably mounted to said base frame of the chair, and elastic means for returning said backrest or countering the rotation thereof, wherein said backrest frame being constrained to said elastic means in correspondence to at least one point of application of the returning or the rotation countering force of said backrest, as well as a preloading mechanism for said elastic means, wherein said preloading mechanism comprises at least one first connecting rod hinged to at least one first crank and hinged to said elastic means to move said point of application of the returning or countering force as a function of the position adopted by said at least one first connecting rod with respect to said base frame, said at least one first crank being hinged to said base frame to rotate a hinge point of said at least one first connecting rod with respect to said base frame, and a manually operable cam device being engaged with said at least one first crank to adjust the position of said at least one first crank in at least two distinct stable positions corresponding to at least two distinct positions of said at least one point of application of the returning or countering force with respect to said base frame, and wherein said cam device comprises at least two contact surfaces in contact with said at least one first crank, said contact surfaces being substantially straight and tilted one with respect to the other.

2. Device according to claim 1, wherein said elastic means comprise a mobile support.

3. Device according to claim 1, wherein said mobile support of said elastic means is at least rotationally constrained to said base frame of said chair.

4. Device according to claim 1, wherein a second connecting rod is hinged to said elastic means and to said at least one first connecting rod, and in a second point of said backrest frame.

5. Device according to claim 1, wherein said at least one first connecting rod is hinged to said elastic means in correspondence to or in proximity of said at least one point of application of the returning and/or countering force.

* * * * *